US007525039B2

(12) United States Patent
Steele

(10) Patent No.: US 7,525,039 B2
(45) Date of Patent: Apr. 28, 2009

(54) ELECTRONIC BASS DRUM

(76) Inventor: Mark David Steele, 1931 Waterford Estates Dr., New Smyrna Beach, FL (US) 32168

( * ) Notice: Subject to any disclaimer, the term of this patent is extended or adjusted under 35 U.S.C. 154(b) by 0 days.

(21) Appl. No.: 11/824,844

(22) Filed: Jul. 3, 2007

(65) Prior Publication Data

US 2009/0007763 A1 Jan. 8, 2009

(51) Int. Cl.
*G10H 1/32* (2006.01)
*G10H 3/00* (2006.01)

(52) U.S. Cl. ..... 84/746; 84/743

(58) Field of Classification Search ..... 84/730, 84/743, 746

See application file for complete search history.

(56) References Cited

U.S. PATENT DOCUMENTS 3,553,339 A * 1/1971 Dominguez et al. ..... 84/725
4,242,937 A * 1/1981 Pozar ..... 84/725
4,732,070 A * 3/1988 Yamashita ..... 84/746
4,819,536 A * 4/1989 Lombardi ..... 84/746
4,947,725 A * 8/1990 Nomura ..... 84/723
5,293,000 A * 3/1994 Adinolfi ..... 84/730
5,361,669 A * 11/1994 Genna ..... 84/414
5,811,709 A * 9/1998 Adinolfi ..... 84/723
6,075,197 A * 6/2000 Chan ..... 84/730
6,121,528 A * 9/2000 May ..... 84/411 R
7,282,633 B1 * 10/2007 Coolidge ..... 84/723
2002/0062726 A1 * 5/2002 Abe ..... 84/464 A
2003/0188629 A1 * 10/2003 Suenaga ..... 84/723
2004/0211310 A1 * 10/2004 Hagiwara et al. ..... 84/726
2006/0021495 A1 * 2/2006 Freitas ..... 84/723
2007/0221040 A1 * 9/2007 Bailey ..... 84/411 R

FOREIGN PATENT DOCUMENTS

JP 2007256623 A * 10/2007

* cited by examiner

*Primary Examiner*—Jeffrey Donels
(74) *Attorney, Agent, or Firm*—William C. Schrot; Edell, Shapiro & Finnan LLC

(57) ABSTRACT

An Electronic Bass Drum includes one or more loudspeakers, an internal amplifier system, an optional electronic drum module and control panel, an impact sensitive electronic kick pad, an attachment for a bass drum pedal, mounting hardware for tom toms or other acoustic or electronic instruments, legs for stabilization, one or more headset jacks for silent play, input jacks for other instruments and/or microphones, and an ipod™ cradle for playing along with music. All of which are enclosed in a cylindrical shell which cosmetically matches the dimensions and design characteristics of a conventional acoustic bass drum.

19 Claims, 11 Drawing Sheets

ELECTRONIC BASS DRUM

REFERENCES CITED

U.S. Patent Documents:

| | | |
|---|---|---|
| 3,553,339 | January, 1971 | Dominguez et al |
| 6,956,596 | March, 2003 | Kuratani et al |
| 3,638,753 | August, 1970 | Cunningham |
| 7,179,985 | February, 2007 | Pickens |
| 4,732,070 | March, 1988 | Yamashita |

STATEMENT OF FEDERALLY SPONSORED RESEARCH/DEVELOPMENT

None

REFERENCE TO SEQUENCE LISTING

None

BACKGROUND OF THE INVENTION

This invention relates generally to the field of musical instruments and more specifically to a complete system for an electronic bass drum.

Virtually every drum kit has a bass drum, whether it is an acoustic set or an electronic set. This invention is designed to replace current bass drums in every type of drum set.

In FIG. 1, a current technology acoustic drum set is presented, including a conventional acoustic bass drum. Note that there is the bass drum itself 21, a special bass drum microphone 22 and individual drum microphones 22*a* for picking up sounds when more volume is required, an amplifier/mixer or P.A. device 23 and speakers 24 to play the sounds to the audience. Also note that the pitch and voice quality of the bass drum always remains the same, and that the whole setup includes several components that are usually spread out and inaccessible to the drummer, most notably the volume control. And that each component usually has its own heavy wooden case that adds to the weight and setup complexity of the system.

FIG. 1*a* shows the same drum kit, except for the acoustic bass drum which has been replaced by my invention 25. Note that all of the peripheral amplification and sound equipment has also been replaced, by my single instrument. And because the invention includes an electronic drum module, the performer is able to control the voice quality of the bass drum at will, and all volume adjustment controls are readily available.

Current technology electronic drum sets FIG. 2, usually include a pedal 26, an impact sensitive electronic kick pad 27, a drum module 28 and an amplification system or P.A. 29 for performing. There are advantages to using an electronic drum set. The tonal quality of the drums is instantly variable; most modern drum modules offer over 500 different sounds, and these sounds are readily changeable depending upon the style of music played. Also, there is usually a volume control that is easily within reach of the drummer. But there are still drawbacks to existing technology. An external amplification or P.A. system 29 still needs to be set up.

In FIG. 2*a*, the electronic bass drum 25 replaces the current kick pad, module, and amplification systems with a single, easily transportable instrument.

Cosmetically, the classic bass drum shape is very much desired by all drummers, and current electronic bass drum technology is shunned by most conventional acoustic drummers for this reason. And there is no system for mounting tom-toms or other percussion instruments on the typical electronic bass drum. My invention overcomes all of these limitations.

BRIEF SUMMARY OF THE INVENTION

An object of the invention is to offer acoustic drummers a bass drum with dozens of different sounds, that cosmetically matches their existing sets.

Another object is to provide an amplification and speaker system built into the shell of a conventional bass drum, eliminating the need for separate components.

A further object is to have tom-tom and other mounting brackets incorporated into an electronic bass drum.

Another object is to have a mounting system for electronic pads that more closely resembles an acoustic set, eliminating bulky racks currently in use.

Yet another object is to eliminate the need for a separate drum module and all of the accompanying wires.

Another object is to have sound level and drum tone changes readily available to the performer.

A further object is to have several acoustic drum microphone jacks readily available.

Yet another object is to have multiple input jacks for the internal drum module readily available.

Another object is to allow other band members the capability of sharing the built-in amplification and speaker systems, conceivably performing solely through this one device.

Yet another object is to incorporate a headset system for a completely quiet band practice.

A further object is to allow for the use of an MP3 player device, such as an IPOD™ device, for practice.

Other objectives and advantages of the present invention will become apparent from the following descriptions, taken in connection with the accompanying drawings, wherein, by way of illustration and example, an embodiment of the present invention is disclosed.

BRIEF DESCRIPTIONS OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 1 shows a common acoustic drum configuration using current technology, as viewed from the front.

FIG. 1*a* shows the same drum set with components replaced by the invention.

FIG. 2 shows a common electronic drum set using current technology, as viewed from the rear.

FIG. 2*a* shows the same electronic drum set with components replaced by the invention.

Figure 9A:
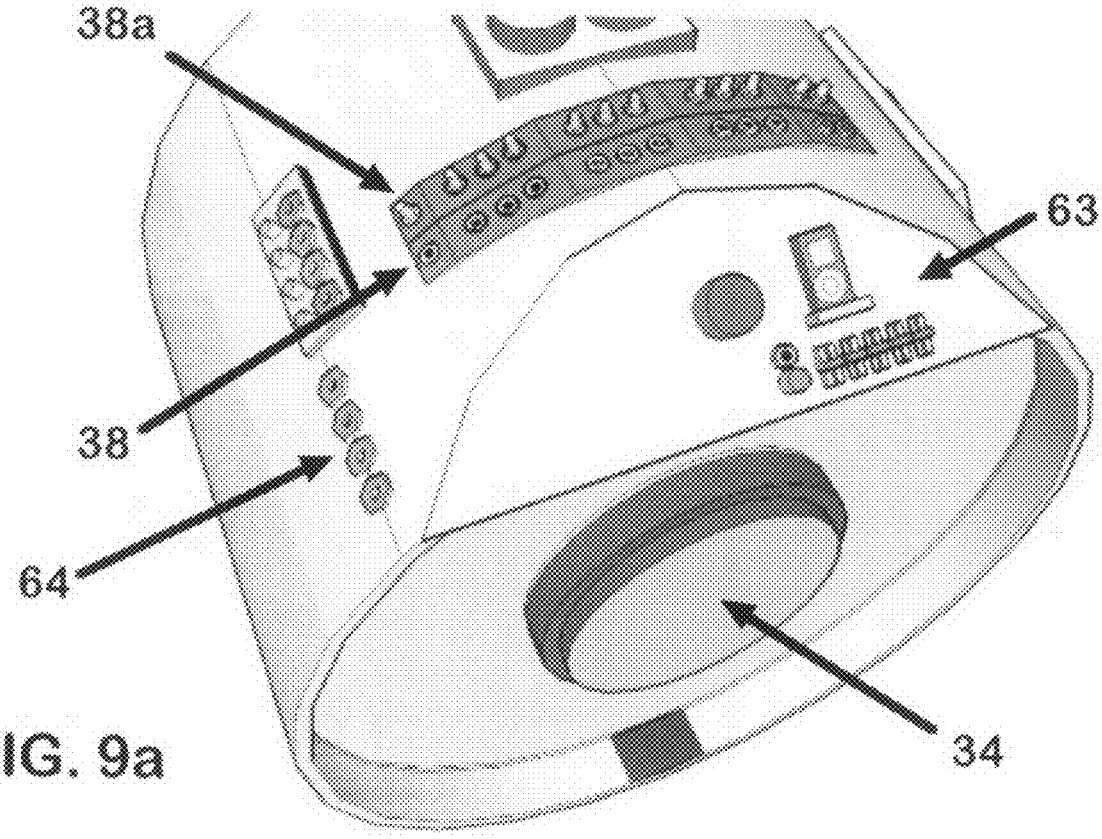

FIG. 9*a* shows a left rear view of an embodiment of the invention for acoustic drum sets, without a built-in drum module.

Figure 9B:
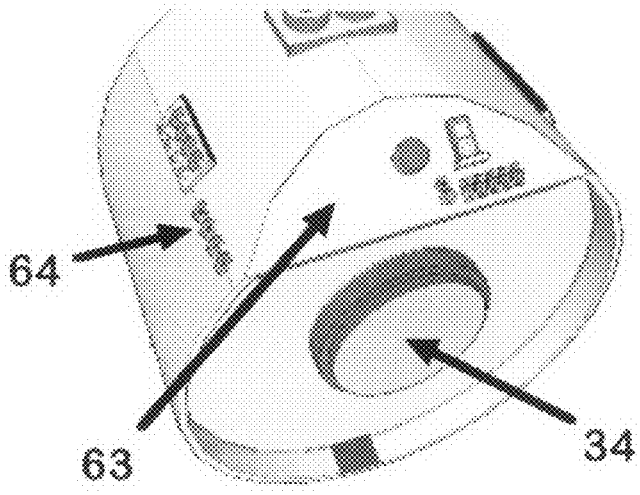

FIG. 9*b* shows a left rear view of an embodiment of the invention for electronic drum sets, without a built-in drum module.

Figure 10:
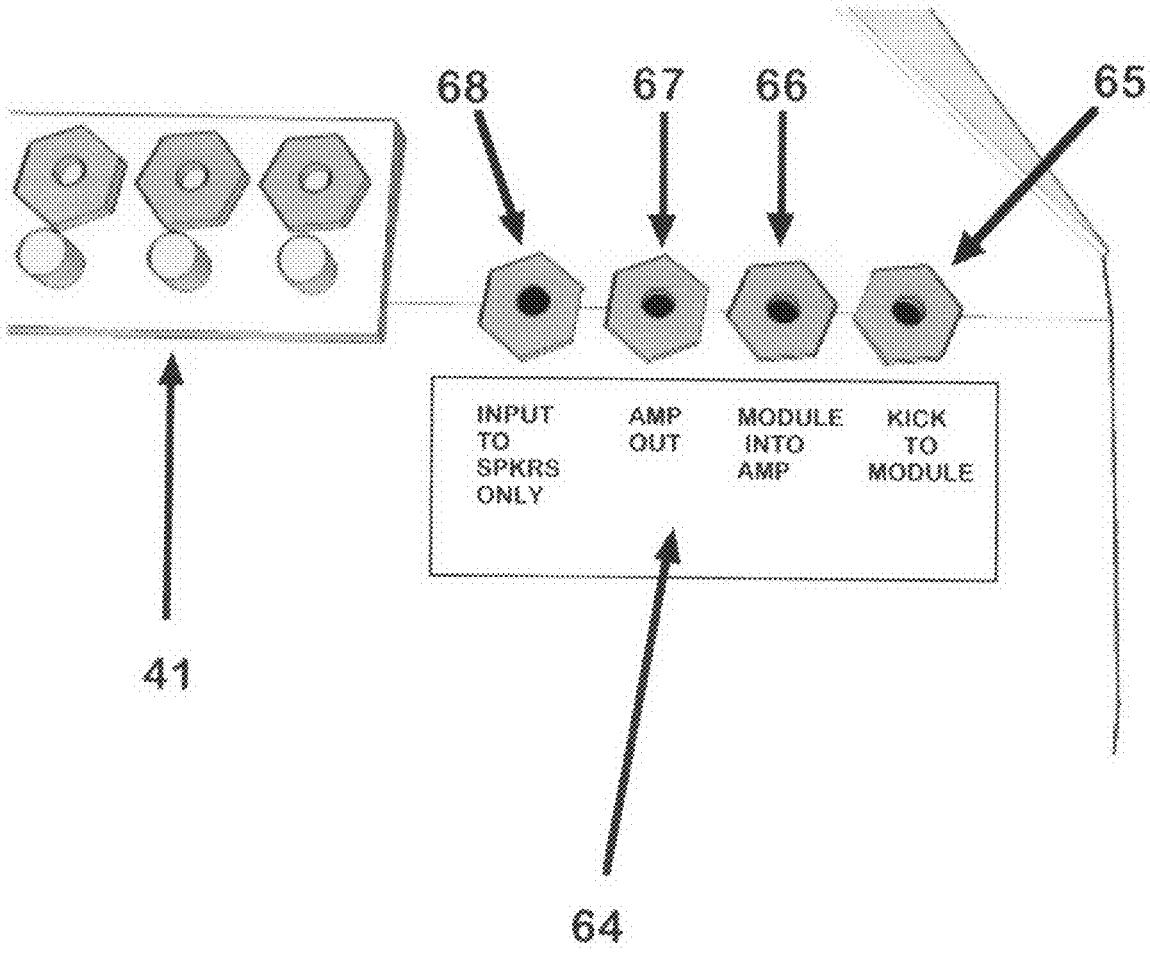

FIG. 10 is a close-up view of the input and output panel required when there is no built-in drum module.

Figure 11:
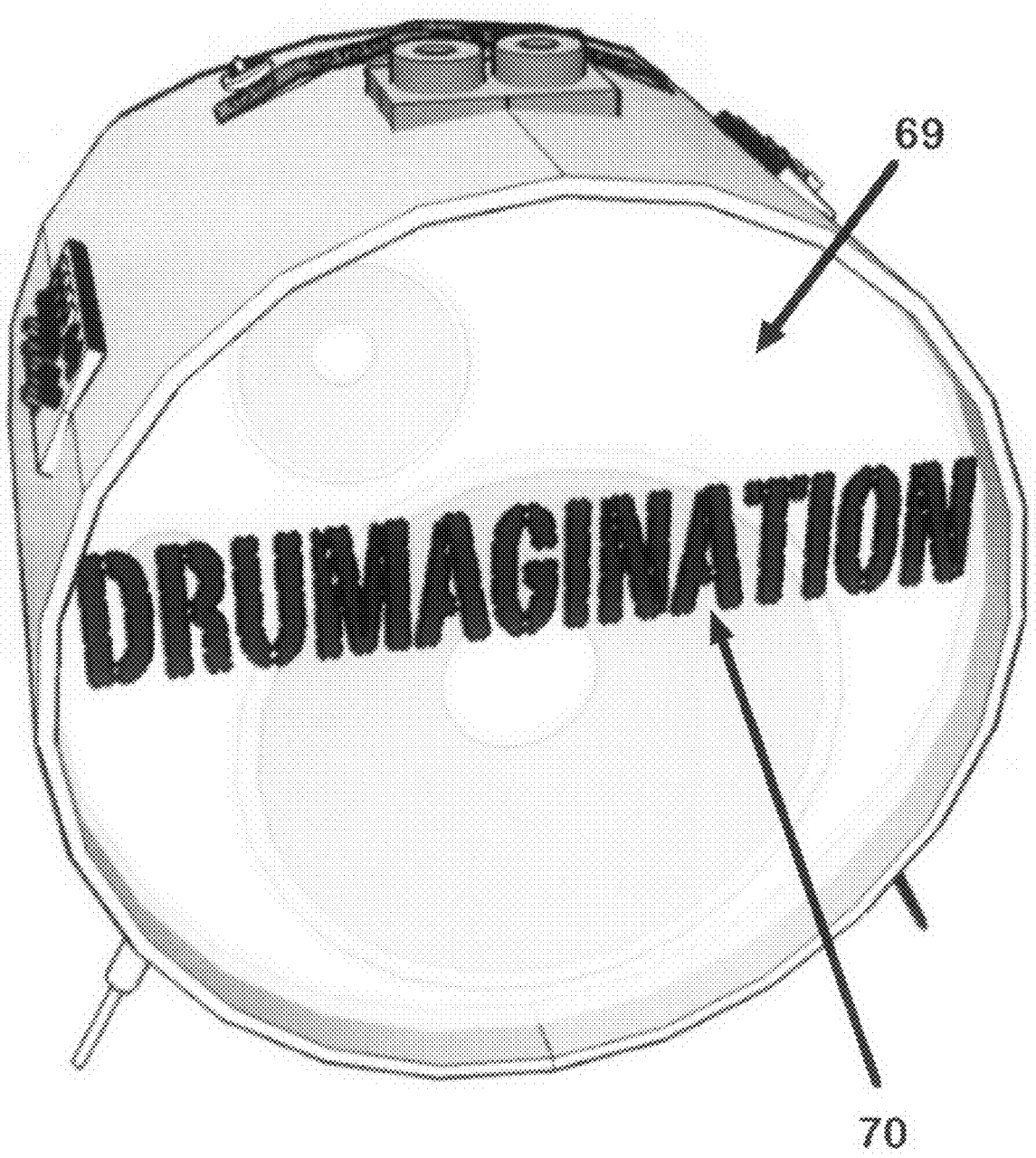

FIG. 11 is a frontal view showing a speaker cover.

DETAILED DESCRIPTION OF THE INVENTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
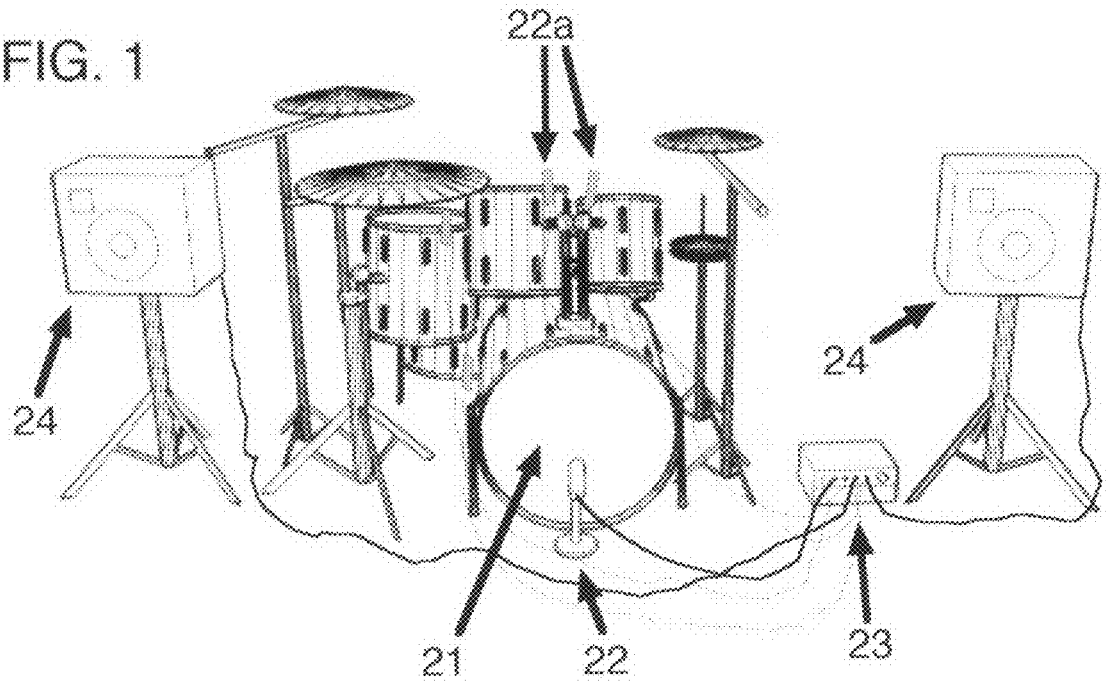
Figure 1A:
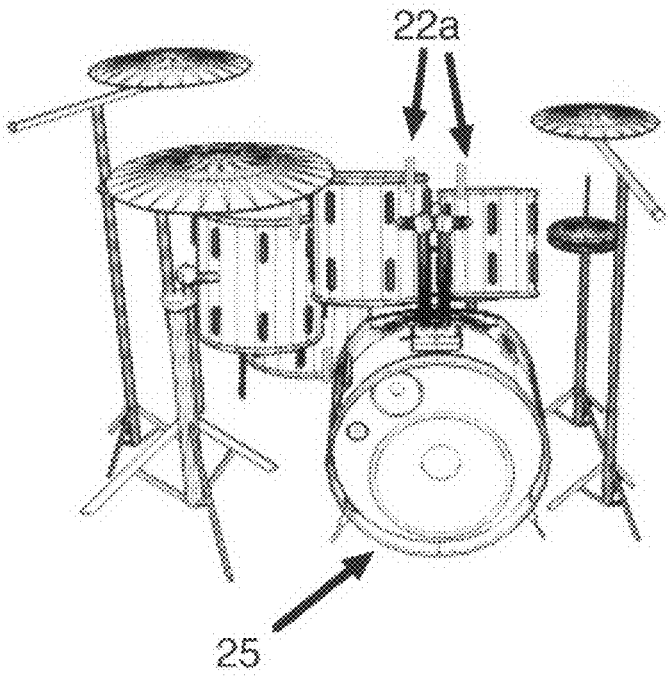
Figure 2:
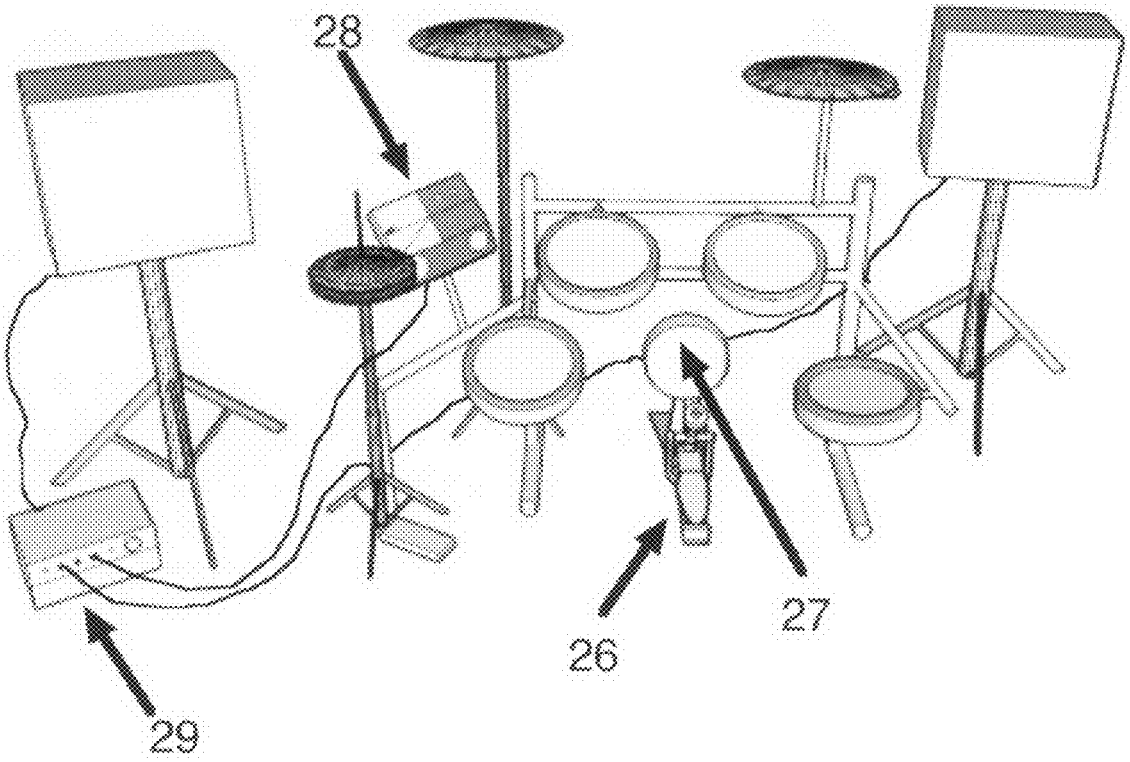
Figure 2A:
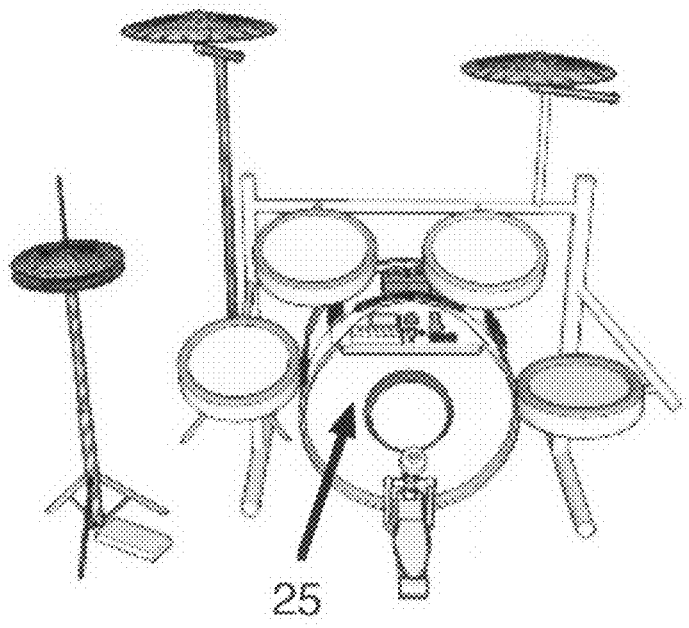
Figure 3:
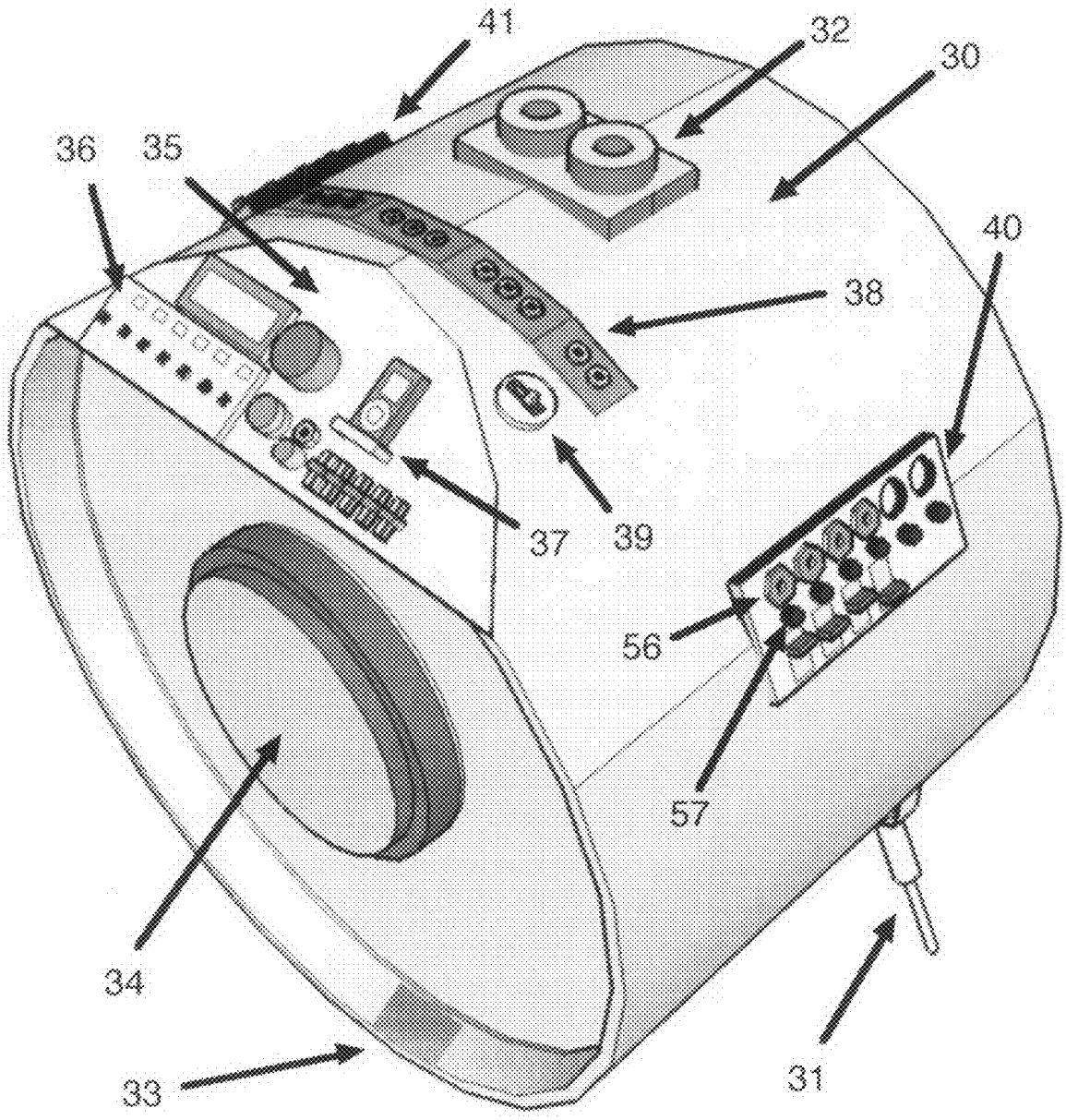
FIG. 3 is an overhead view from the right rear of the invention showing the primary features.

FIG. 3 gives an overview of most of the essential parts of the electronic bass drum in accordance with one embodiment of the invention, wherein the parts identical to those shown in FIGS. 3 through 11 are designated by the same reference numerals. A cylindrical outer shell 30 is used which has dimensions that are very similar to prior art acoustic bass drum shells. In fact, prior art wooden or acrylic bass drum shells would be useable, and the external finish of said outer shell would probably match the other drums in each individual kit. Stabilization legs 31 and tom-tom mounts 32 are widely available for prior art acoustic bass drums and are useable in the invention as well. All other percussion instrument mounting systems designed for conventional acoustic bass drums will work on this electronic bass drum. The invention is designed to cosmetically mimic existing acoustic bass drums to the fullest extent possible. There is an attachment point 33 for mounting a bass drum pedal at the rear of the invention, and an impact-sensitive electronic drum kick pad 34 is installed for striking with said bass drum pedal. The electronic kick pad signal is sent to the integral bass drum module 36 that is part of the control panel 35. There is an MP3 player receptacle 37 that allows the drummer to practice along with music. There are several dual purpose input jacks 38. Drummers who use electronic drums need input jacks for their electronic pads. Acoustic drummers will want input jacks for their drum microphones. A unique switch 39 changes the function of the jacks, and routes all signals either to the drum module in the case of electronic pads, or directly to the internal amplifier in the ease of microphones. Optional microphone volume adjustment controls are shown in FIG. 9*a*, item 38*a*. The auxiliary input panel 40 of FIG. 3 has several input jacks 56 that allow other performers to play their instruments through the internal amplifier of the invention. Each input to the amplifier has an input volume control 57. There is also an auxiliary headset panel 41 that allows several band members to listen to the combined inputs to the internal amplifier, as well as the built-in drum module 35 and MP3 player as desired. This arrangement is designed so that an entire band can plug into the invention and practice together silently through headsets, or perform together through the integrated amplifier and speaker system.

Figure 4:
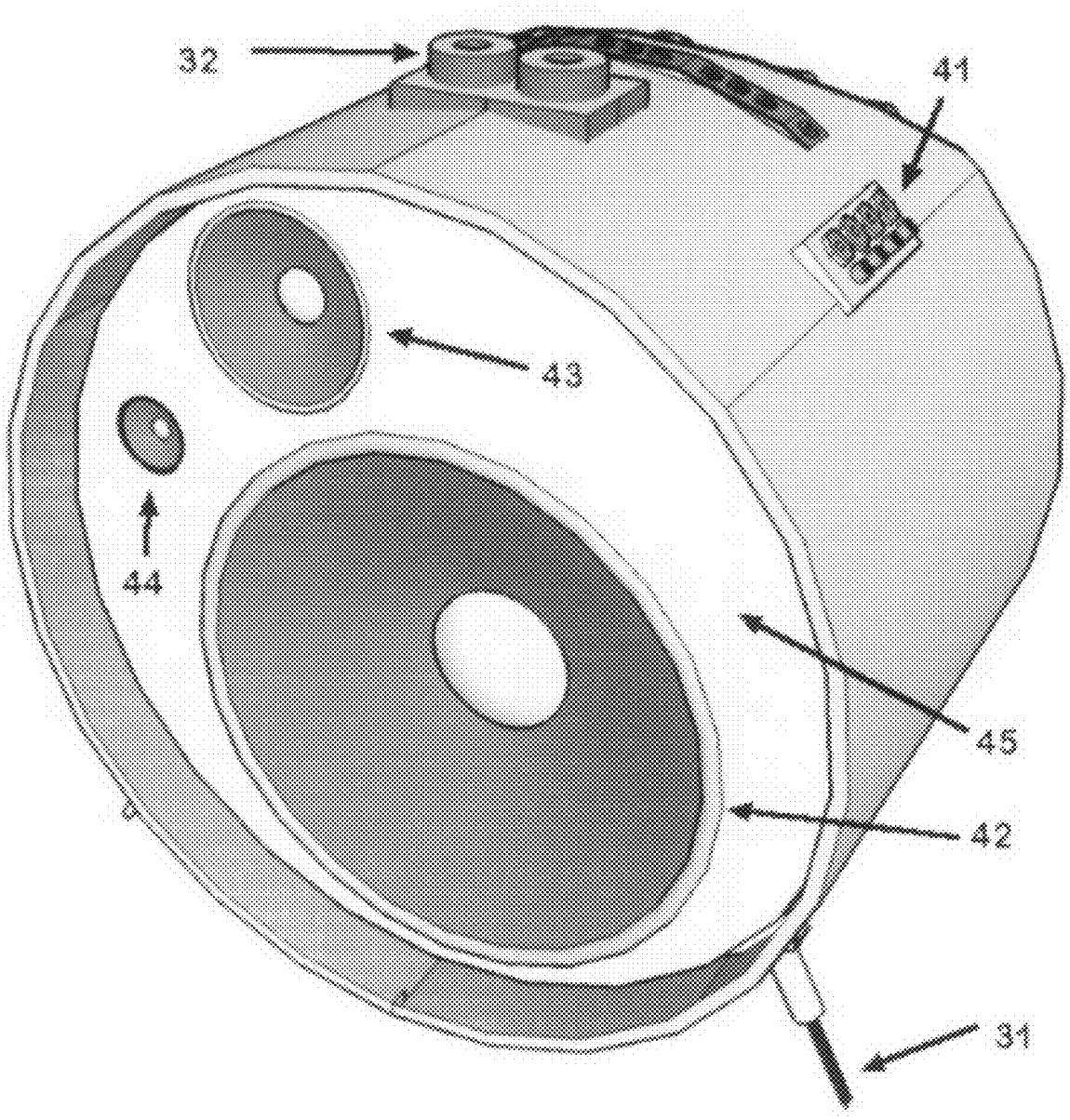
FIG. 4 is a frontal view showing loudspeaker installation.

FIG. 4 shows the front end of the instrument, where one or more loudspeakers or drivers can be mounted in a variety of ways. In this embodiment, there is depicted a woofer 42, a mid-range speaker 43 and a tweeter 44 all mounted to the forward wall 45.

Figure 5:
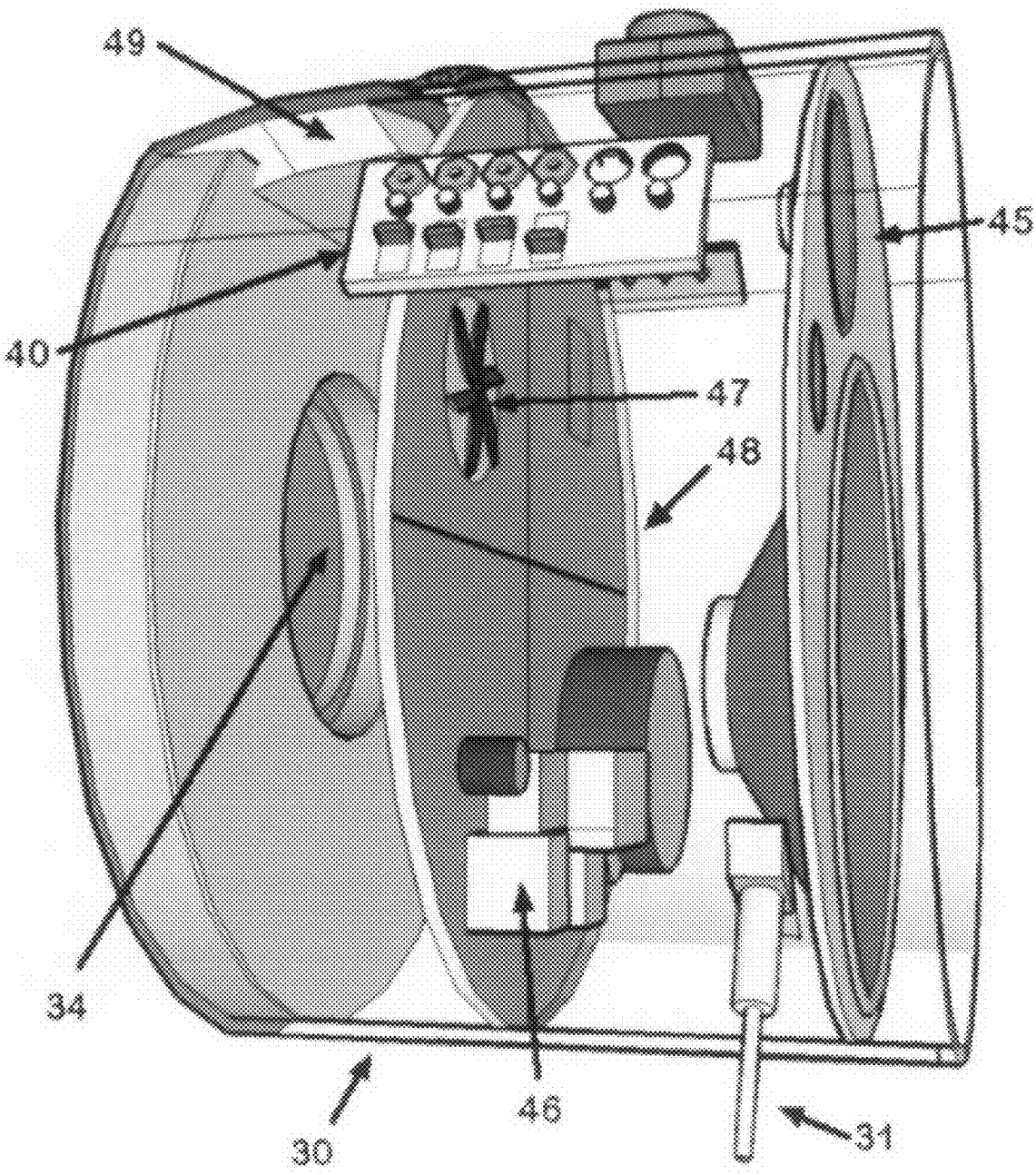
FIG. 5 is a cutaway view showing the internal components of the invention.

FIG. 5 is a cutaway view of the internal parts of the instrument, and shows how several previously separate components can be combined into a single instrument. The internal amplifier 46 is mounted to wall 48. There is an optional internal cooling fan 47 that circulates air throughout the invention, in order to prevent the overheating of the electronics of the invention. The drum module electronics are installed in a compartment 49 beneath the main control panel in this embodiment. There is more than adequate room for an array of speakers mounted on the forward wall 45.

Figure 6:
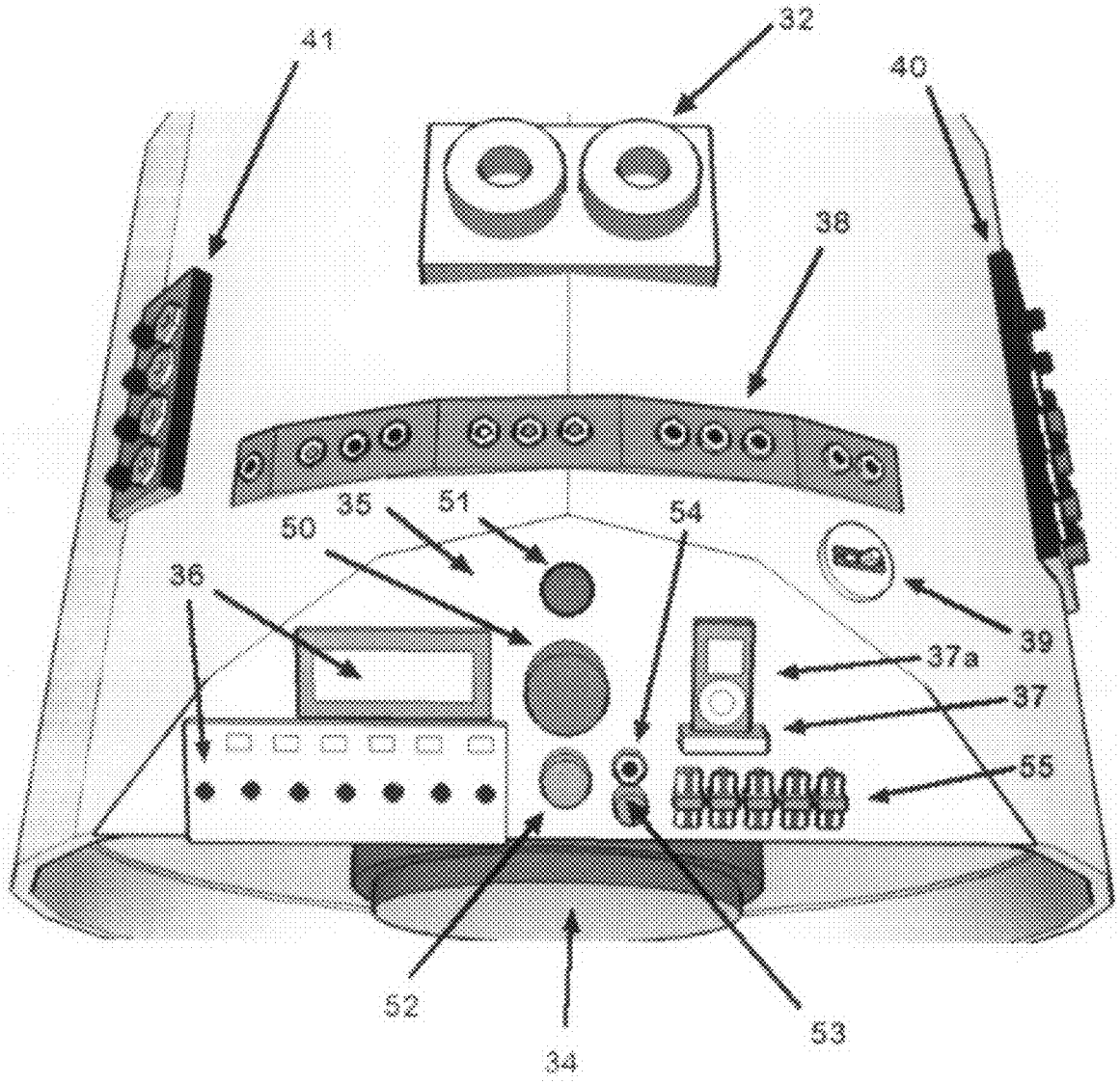
FIG. 6 shows the electronic controls and external components from the top rear of the invention, viewed from the right side.

FIG. 6 shows a close-up of the main control panel 35 for the internal amplifier and the integral drum module. Note that this is but one possible arrangement, and there are several ways to set up the controls. All critical control functions are easily within reach, starting with the master amplifier volume control knob 50. The drum set select knob 52 enables the performer to quickly change the tonal quality of the externally mounted kick pad 34 as well as all other electronic percussion instruments plugged into the device using the input jacks 38. The module output volume control knob 51 is used to vary the output level of the sounds sent from the drum module to the amplifier. If several musicians were plugged into the invention using the input panel 40 and the drum sound level was too high for the group, this control would be used to lessen the sound level of the drums only. Since most drummers use recorded music to practice with, there is included an MP3 player dock 37 which holds in MP3 player, for example a standard IPOD™ device 37*a*. The output from the MP3 player can be heard though the drummer's headphone jack 54 along with all other inputs to the internal amplifier. A volume control 53 for the headset jack 54 is included.

The relative volume for all of the inputs can be controlled by the drummer using the volume adjustment switches 55. Note that all functions can be changed quickly and easily, and in many cases levels will be adjusted during live play.

Figure 7:
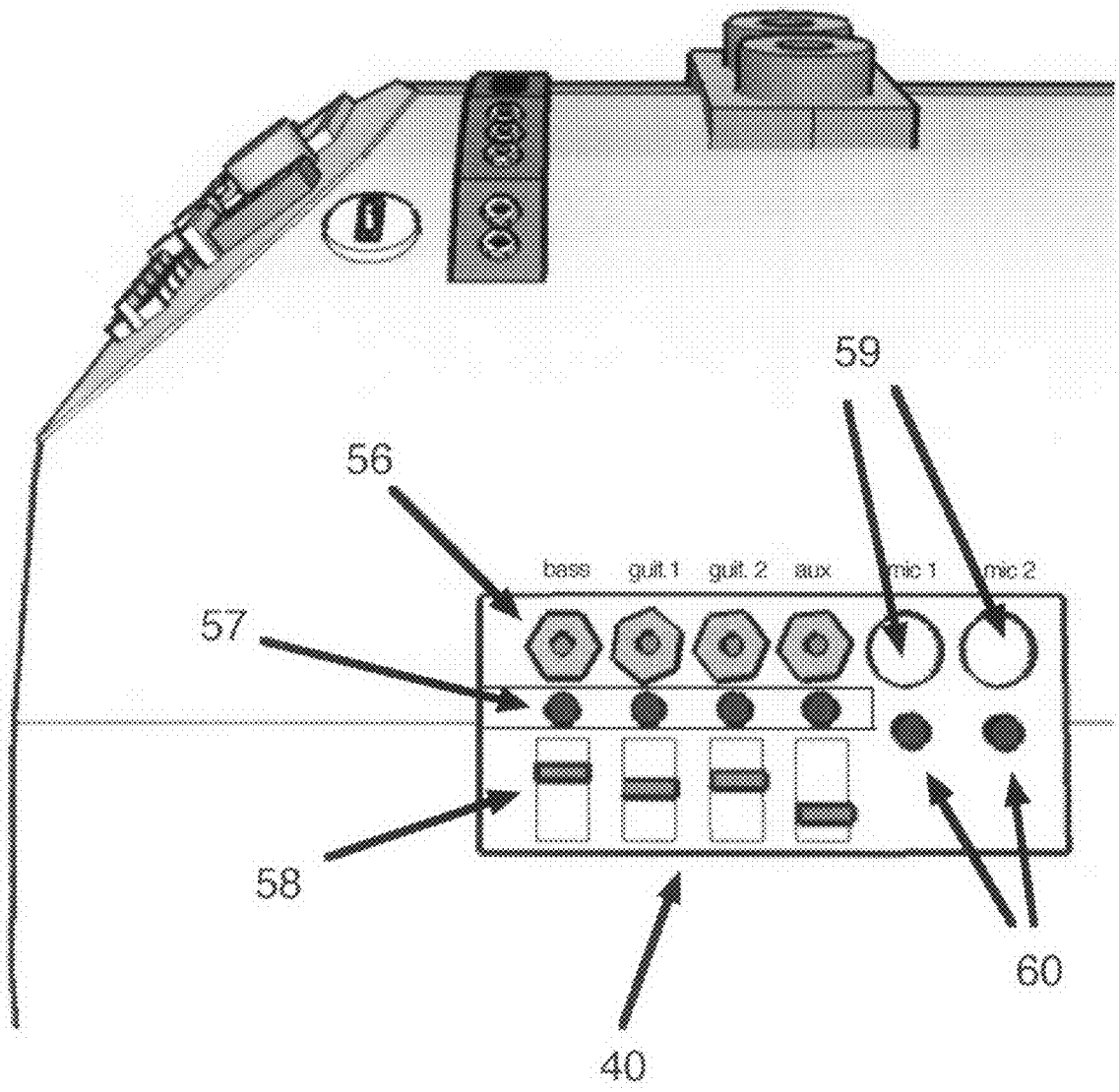
FIG. 7 shows the auxiliary inputs panel on the right side of the instrument.

FIG. 7 shows the right side of the instrument where the input panel 40 could be located. There is depicted a row of input jacks 56 for other band members to plug in their electric instruments, and each input has a volume control 57 and an equalizer control 58. Two input jacks for microphones 59 are also shown, with their respective volume control knobs 60. The number of inputs may vary.

Figure 8:
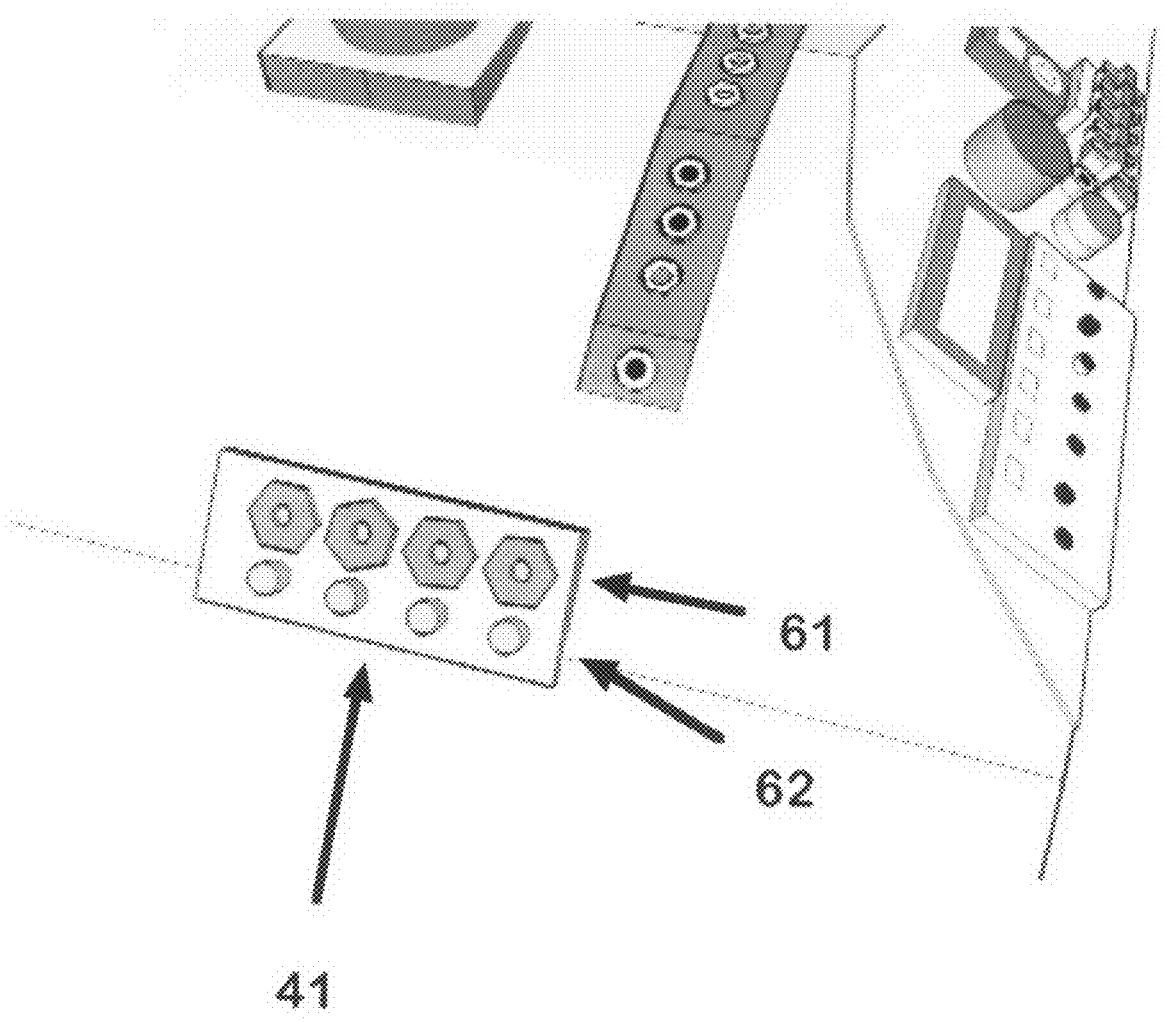
FIG. 8 shows the headphone jack panel viewed from the left side of the invention.

FIG. 8 shows the left side of the invention where the headphones panel 41 could be located. There is depicted a row of headset jacks 61 with each jack having its respective volume control 62. The number ofjacks may vary. The purpose of this panel is to allow several musicians to listen to any or all of the inputs to the internal amplifier, which may include a drum module, the MP3 player and every musician or singer who is plugged into the previously discussed input panel in FIG. 7. The purpose of this arrangement is to allow an entire band to rehearse together in situations where noise output from instruments or amplifiers is not allowed, wherein every player can hear all other players simultaneously, while also listening to an MP3 player song if desired.

For drummers who already own drum modules and want a less expensive electronic bass drum, two other embodiments of the invention are offered in FIGS. 9*a* and 9*b*. Note that the control panel 63 in both embodiments does not contain a drum module. The embodiment shown in FIG. 9*a* is designed for drummers with acoustic drum sets who already own or wish to use an external electronic drum module. Microphone input jacks 38 used for the rest of the acoustic set are shown with optional individual volume adjustment controls 38*a*, and these signals are sent directly to the internal amplifier.

FIG. 9*b* shows an electronic bass drum for an electronic set wherein the drummer has an external drum module, and doesn't need an integrated module in the electronic bass drum. Note that input jacks 38 for drum pads or other electronic instruments are not required in this case, since commercial drum modules all have these input jacks built in.

In both the acoustic and electronic drum setups, the output from the integral electronic kick pad 34 needs to be routed to an external drum module, and signals from the external drum module need to be connected back into the internal amplifier and speaker systems in the invention. This is accomplished using the signal jack panel 64 depicted at the left side of the invention.

FIG. 10 shows a close-up of said panel, comprising an output jack 65 that takes the signals from the integral electronic kick pad to an external drum module when said module is connected to this jack. After the kick pad electronic input is received by said drum module, a signal is produced, then routed to the input jack 66 which connects to the internal amplifier of the invention.

Two auxiliary jacks are also depicted in FIG. 10, and these jacks can be used in any embodiment of the invention. The output jack for connecting an external amplifier 67 could be used in situations where the internal amplifier and speakers of the invention are not powerful enough to be heard by an entire audience, at a stadium concert for example. The signal from this jack is produced by the internal amplifier, based upon inputs received and sound levels commanded by the drummer. This signal could then conceivably be routed to a huge external amplifier, and a massive wall of speakers could fill the stadium with sound.

The input jack for connecting an external amplifier directly to the loudspeaker or speakers 68 is used when speakers alone are needed by an external amplifier, and the signal from this jack bypasses the internal amplifier of the invention and goes directly to the loudspeakers at the front of the electronic bass drum.

In order to protect the loudspeakers at the front of the instrument from dust, debris or physical damage, a cover is depicted in FIG. 11. This cover could be made out of speaker cloth or other loosely woven material, so as to allow the sound produced by the speakers to fully project to the audience. Note that a band name or other logo 70 could be written on said cover, completing the mimicry of existing acoustic bass drums.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

The invention claimed is:

1. An electronic bass drum assembly comprising:

an outer shell having a front planar wall and a side wall, said outer shell defining an interior cavity;

at least one loudspeaker disposed within said interior cavity and mounted on said front planar wall;

an internal amplifier disposed within said interior cavity, said internal amplifier electrically coupled to and powering said at least one loudspeaker;

a drum module disposed within said interior cavity and electrically coupled to said amplifier;

a plurality of input jacks disposed on said outer shell, each of said input jacks electrically coupled to one of said drum module and said internal amplifier, wherein an external electronic device is connectable to one of said input jacks and thereby in communication with a corresponding one of said drum module and said internal amplifier for sending an input signal thereto;

a control panel disposed on said outer shell, said control panel having a plurality of controls in communication with at least one of said drum module and said internal amplifier for controlling input signals thereto; and an impact sensitive electronic drum kick pad electrically coupled to said drum module.

2. The electronic bass drum assembly of claim 1, wherein at least one of said controls is a volume adjustment control.

3. The electronic bass drum assembly of claim 1, wherein at least one of said input jacks is electrically coupled to said internal amplifier, and another of said input jacks is electrically coupled to said drum module.

4. The electronic bass drum assembly of claim 1, wherein at least one of said controls is in communication with said drum module and at least another of said controls is in communication with said internal amplifier.

5. The electronic bass drum assembly of claim 1, further comprising a switch operably associated with at least one of said input jacks, said switch having a first position wherein the input signals are routed to said drum module and a second position wherein the input signals are routed to said amplifier, so that the external electronic device is connectable to the associated input jack and selectably in communication with one of said drum module and said amplifier.

6. The electronic bass drum assembly of claim 1, wherein said external electronic device is selected from the group consisting of an external electronic instrument, a microphone, and an external drum module.

7. The electronic bass drum assembly of claim 1, wherein said control panel further comprises an MP3 player dock operably associated with at least one of a headset jack and said internal amplifier, said MP3 player dock connectable to an associated external MP3 player.

8. The electronic bass drum assembly of claim 7, further comprising a plurality of headset jacks disposed on said outer shell.

9. The electronic bass drum assembly of claim 8, wherein said headset jacks are disposed on said control panel.

10. The electronic bass drum assembly of claim 1, further comprising an internal cooling fan disposed within said interior cavity.

11. The electronic bass drum assembly of claim 1, further comprising stabilization legs extending outwardly from said outer shell.

12. The electronic bass drum assembly of claim 1, further comprising mounting hardware configured for mounting additional percussion instruments to said outer shell.

13. The electronic bass drum assembly of claim 1, further comprising a cover configured for being mounted over at least a portion of said front planar wall for protecting said at least one loudspeaker.

14. The electronic bass drum assembly of claim 1, further comprising an output jack operably disposed on said outer shell and operably associated with said impact sensitive electronic drum kick pad, a secondary drum module connectable to said impact sensitive electronic drum kick pad via said output jack.

15. The electronic bass drum assembly of claim 1, further comprising an output jack operably disposed on said outer shell and operably associated with said at least one loudspeaker, an external amplifier connectable to said at least one loudspeaker via said output jack.

16. The electronic bass drum assembly of claim 1, further comprising a plurality of volume controls disposed on said outer shell, each of said volume controls operably associated with a corresponding one of said input jacks.

17. The electronic bass drum assembly of claim 16, wherein said plurality of volume controls are disposed on said control panel.

18. The electronic bass drum assembly of claim 1, further comprising at least one equalizer control disposed on said outer shell and operably associated with a corresponding one of said input jacks.

19. The electronic bass drum assembly of claim 18, wherein said at least one equalizer control is disposed on said control panel.

* * * * *